US007445531B1

(12) United States Patent
Ross et al.

(10) Patent No.: US 7,445,531 B1
(45) Date of Patent: Nov. 4, 2008

(54) SYSTEM AND RELATED METHODS FOR MARINE TRANSPORTATION

(76) Inventors: Anthony C. Ross, 3546 Maybank Hwy., John's Island, SC (US) 29455; Russel Ross, 5111 8th Rd. South, Apt 302, Arlington, VA (US) 22204

( * ) Notice: Subject to any disclaimer, the term of this patent is extended or adjusted under 35 U.S.C. 154(b) by 0 days.

(21) Appl. No.: 10/926,626

(22) Filed: Aug. 25, 2004

Related U.S. Application Data

(60) Provisional application No. 60/497,806, filed on Aug. 25, 2003, provisional application No. 60/497,836, filed on Aug. 25, 2003.

(51) Int. Cl.
*B63H 11/04* (2006.01)

(52) U.S. Cl. ..... 440/38; 417/273

(58) Field of Classification Search ..... 440/38, 440/40, 44; 417/412, 472, 474, 475, 273, 417/392, 394, 478, 473; 92/23, 52, 89, 93, 92/105

See application file for complete search history.

(56) References Cited

U.S. PATENT DOCUMENTS

| | | | | |
|---|---|---|---|---|
| 1,546,973 | A | 7/1925 | Ellis | |
| 2,056,475 | A | 10/1936 | Marx | |
| 2,726,624 | A * | 12/1955 | Raicy | 440/23 |
| 2,807,216 | A | 9/1957 | Bielstein | |
| 2,815,715 | A | 12/1957 | Tremblay | |
| 2,971,471 | A | 2/1961 | Huebschman | |
| 3,048,121 | A | 8/1962 | Sheesley | |
| 3,062,002 | A | 11/1962 | Shaffer | |
| 3,074,351 | A | 1/1963 | Foster | |
| 3,136,257 | A | 6/1964 | Smith et al. | |
| 3,190,229 | A | 6/1965 | Turowski | |
| 3,194,170 | A * | 7/1965 | Ulbing | 417/394 |
| 3,215,084 | A | 11/1965 | Cline | |
| 3,216,413 | A | 11/1965 | Mota | |
| 3,307,358 | A * | 3/1967 | De Kerandrao | 60/221 |
| 3,359,735 | A | 12/1967 | Yeager | |
| 3,677,667 | A | 7/1972 | Morrison | |
| 3,765,175 | A | 10/1973 | Ohnaka | |
| 3,783,453 | A | 1/1974 | Bolie | |
| 3,826,217 | A | 7/1974 | Canova | |
| 3,836,289 | A | 9/1974 | Wolford et al. | |
| 3,839,983 | A | 10/1974 | McAusland | |
| 3,945,201 | A | 3/1976 | Entringer | |
| 4,026,235 | A | 5/1977 | Woodfill | |
| 4,031,844 | A | 6/1977 | Onal et al. | |
| 4,076,467 | A | 2/1978 | Persson | |
| 4,389,169 | A | 6/1983 | De Dionigi | |

(Continued)

FOREIGN PATENT DOCUMENTS

| | | |
|---|---|---|
| DE | 3004109 | 3/1981 |

(Continued)

OTHER PUBLICATIONS

Apr. 4, 2007, Non-Final Rejection, in U.S. Appl. No. 10/926,627.

(Continued)

*Primary Examiner*—Sherman Basinger

(57) ABSTRACT

A system and related methods for manned and/or unmanned marine transportation involving equipping a vessel capable with a linear pump for propelling the vessel through or substantially over a body of water.

18 Claims, 6 Drawing Sheets

U.S. PATENT DOCUMENTS 4,424,009 A * 1/1984 van Os ..... 417/394
4,439,112 A 3/1984 Kitsnik
4,488,854 A 12/1984 Miller
4,744,900 A 5/1988 Bratt
4,787,823 A 11/1988 Hultman
4,925,377 A 5/1990 Inacio et al.
5,085,563 A 2/1992 Collins et al.
5,108,426 A 4/1992 Biro et al.
5,209,654 A 5/1993 Nilsson et al.
5,298,818 A 3/1994 Tada
5,333,444 A 8/1994 Meng
5,401,195 A * 3/1995 Yocom ..... 440/6
5,411,381 A 5/1995 Perrodin
5,567,131 A 10/1996 McNaull
5,620,048 A 4/1997 Beauquin
5,676,162 A 10/1997 Larson, Jr. et al.
5,676,651 A 10/1997 Larson, Jr. et al.
5,693,091 A 12/1997 Larson, Jr. et al.
5,717,259 A 2/1998 Schexnayder
5,722,930 A 3/1998 Larson, Jr. et al.
5,758,666 A 6/1998 Larson, Jr. et al.
5,879,375 A 3/1999 Larson, Jr. et al.
5,915,930 A 6/1999 McNaull
5,964,580 A 10/1999 Taga
6,000,353 A * 12/1999 De Leu ..... 114/61.1
6,012,910 A 1/2000 McNaull
6,273,015 B1 * 8/2001 Motsenbocker et al. .. 114/61.12
6,273,771 B1 * 8/2001 Buckley et al. ..... 440/84
6,352,455 B1 * 3/2002 Guagliano et al. ..... 440/38
6,464,476 B2 10/2002 Ross et al.
6,607,368 B1 8/2003 Ross et al.

FOREIGN PATENT DOCUMENTS

JP 0115906 10/1978

OTHER PUBLICATIONS

Aug. 6, 2007, Responsive Amendment, in U.S. Appl. No. 10/926,627.
Oct. 30, 2007, Final Rejection, in U.S. Appl. No. 10/926,627.
Dec. 31, 2007, Request for Continued Examination and Responsive Amendment, in U.S. Appl. No. 10/926,627.
Feb. 26, 2008, Non-final Rejection, in U.S. Appl. No. 10/926,627.

* cited by examiner

SYSTEM AND RELATED METHODS FOR MARINE TRANSPORTATION

CROSS-REFERENCES TO RELATED APPLICATIONS

The present application is a U.S. Non-Provisional Patent Application of and claims the benefit of priority from commonly owned and U.S. Provisional Patent Application Ser. No. 60/497,806 (filed Aug. 25, 2003) and Ser. No. 60/497,836 (filed Aug. 25, 2003), the entire contents of which are hereby expressly incorporated by reference into this disclosure as if set forth fully herein.

BACKGROUND OF THE INVENTION

I. Field of the Invention

The present invention relates generally to marine transportation and, more particularly, to an improved system and related methods for manned and/or unmanned marine transportation.

II. Discussion of the Prior Art

Various challenges exist in creating unmanned transportation for marine applications. The present invention is directed at overcoming, or at least improving upon, the disadvantages of the prior art.

SUMMARY OF THE INVENTION

The present invention comprises a vehicle for unmanned marine transportation. According to one embodiment of the present invention, this is accomplished by equipping a marine vessel or boat with a bank of batteries to power the various systems on the vessel, a plurality of solar cells to augment and/or supplant the battery bank, a computer guidance system for guiding and operating the various systems on the vessel, an antenna for sending and/or receiving data or signals, a plurality of sensors for providing feedback or input to the various systems on the vessel, a motor capable of being swiveled between a stability-providing position and a drive position, and one or more rudders for steering the vessel.

In a preferred embodiment, the motor comprises a linear pump that produces power on all strokes and allows full six degrees of freedom (6DOF) vectoring for rapid and efficient directional control. There are very few parts thereby significantly reducing the maintenance, life cycle cost, energy consumption, weight, and volume. By way of example only, the linear pump may be of a type generally shown and described in U.S. Pat. Nos. 6,352,455 and 6,607,368, the entire contents of which are hereby incorporated into this disclosure as if set forth in their entirety herein.

In another embodiment of the present invention, the linear pump is similar to the linear pumps of the '455 and '368 patents in that it includes an inner chamber disposed within an outer chamber, each having one or more inlets and outlets for passing fluid into and out of each respective chamber to pump fluid. The linear pump of the present invention is different from (and improved relative to) the linear pump of the '455 and '368 patents in that the outer chamber and inner chamber are both generally rigid, wherein the circumference of the inner chamber may be adjusted via a plurality of generally rigid ribs and linear motors, and wherein the end plates do NOT move relative to one another.

In one embodiment, the outer chamber of linear pump is generally rigid, and includes a plurality of intake ports to permit fluid to enter into the outer chamber (including but not limited to one-way check valves) and a plurality of outlet ports to permit movement of the fluid or relative fluid of the device (including but not limited to one-way check valves). The inner chamber is constructed from a plurality of generally rigid plate members or "slat-like" ribs which run the length of the pumping system of the present invention. Each rib member cooperates with one or more linear motors such that the rib members may be selectively forced in a radial (i.e. outward) direction and medical (i.e. inward) direction.

To facilitate this radial and medial motion, each rib member is equipped with an articulating member which engages into a groove formed within an adjacent rib member. As an example, both the rib members and the articulating members are generally curved such that the inner chamber is generally cylindrical. As the linear motors are operated, the rib members are caused to expand and contract within the generally rigid outer chamber. In a preferred embodiment, the linear motors include permanent magnets, but any of a variety of suitable linear drive mechanisms may be employed without departing from the scope of the present invention, including but not limited to hydraulic and pneumatic systems. To ensure no pressure loss during operation, the articulating member may be equipped with any of a variety of sealing feature, including but not limited to O-rings or the like to prevent the passage of fluid in between the adjacent rib members during contraction and/or expansion.

One advantage of this design is that, unlike the linear pump systems shown and described in the '455 or '368 patents, the inner chamber is not a bladder which will stretch and recover. The power is 90-degree opposition, which provides close to a 100% power exchange instead of the 70% with the flexible bladder of the '455 or '368 patents. This is a significant distinction in that it will allow the pump of the present invention, when attached to a vehicle or appropriate size and construction, to actually propel the vehicle from a position on top of or under the water to an airborne state out of the water.

In an alternative embodiment, the outer chamber of linear pump has inlets and outlets disposed along the outer periphery of the outer chamber. Each embodiment of the linear pump disclosed herein is capable of simultaneously discharging the fluid within the inner chamber while fluid is charged or delivered into the outer chamber according to the present invention. The inverse is also true, wherein the linear pump is capable of simultaneously discharging the fluid within the outer chamber while fluid is charged or delivered into the inner chamber according to the present invention.

Although described herein as suitable for unmanned use, it will be appreciated that the marine vessel of the present invention may also be equipped to be manned with one or more users.

BRIEF DESCRIPTION OF THE DRAWINGS

Many advantages of the present invention will be apparent to those skilled in the art with a reading of this specification in conjunction with the attached drawings, wherein like reference numerals are applied to like elements and wherein.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The linear pump of the present invention disclosed herein boasts a variety of inventive features and components that warrant patent protection, both individually and in combination.

Figure 1:
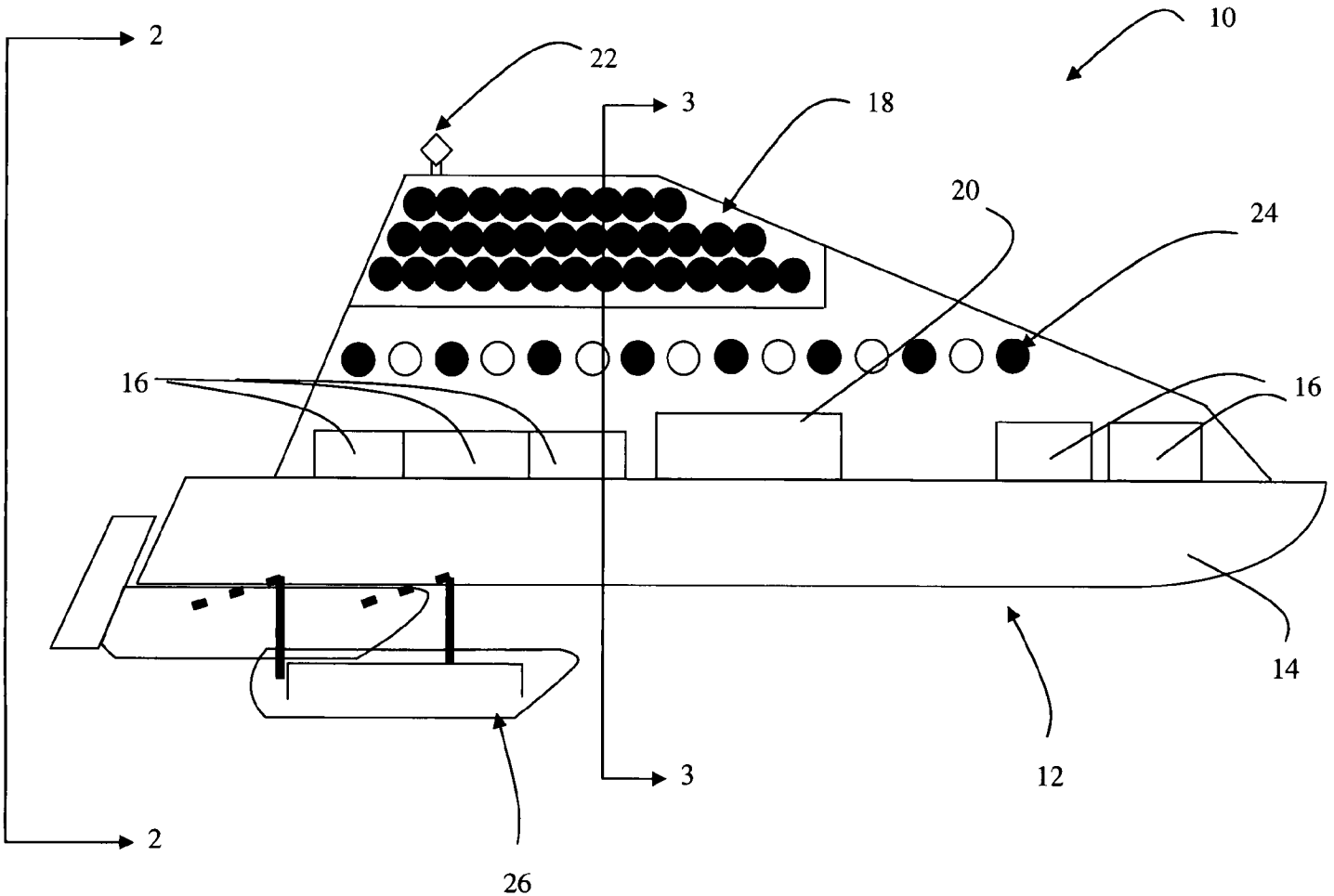
FIG. 1 is a side view of a marine transportation vehicle of the present invention.
Figure 2:
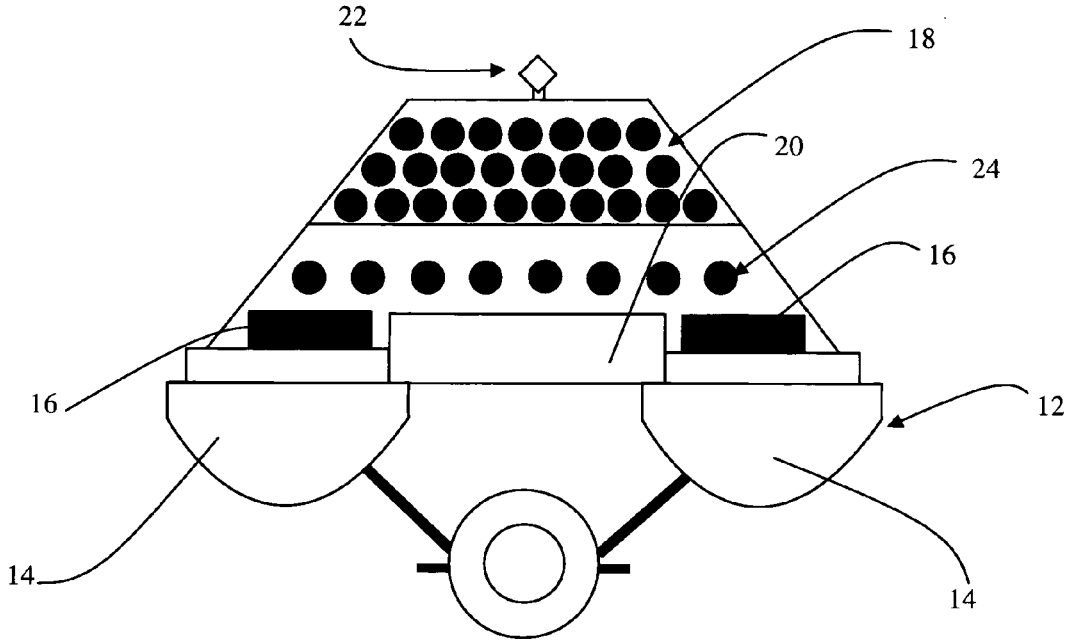
FIG. 2 is an end view of the marine transportation vehicle of the present invention taken along lines 2-2 in FIG. 1.
Figure 3:
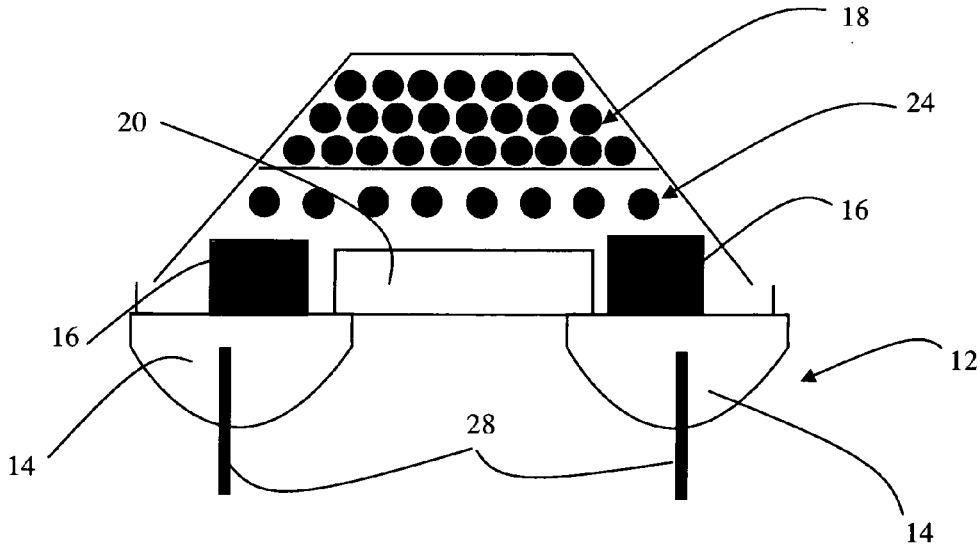
FIG. 3 is a partial sectional view of the marine transportation vehicle of the present invention taken along lines 3-3 in FIG. 1.
Figure 4:
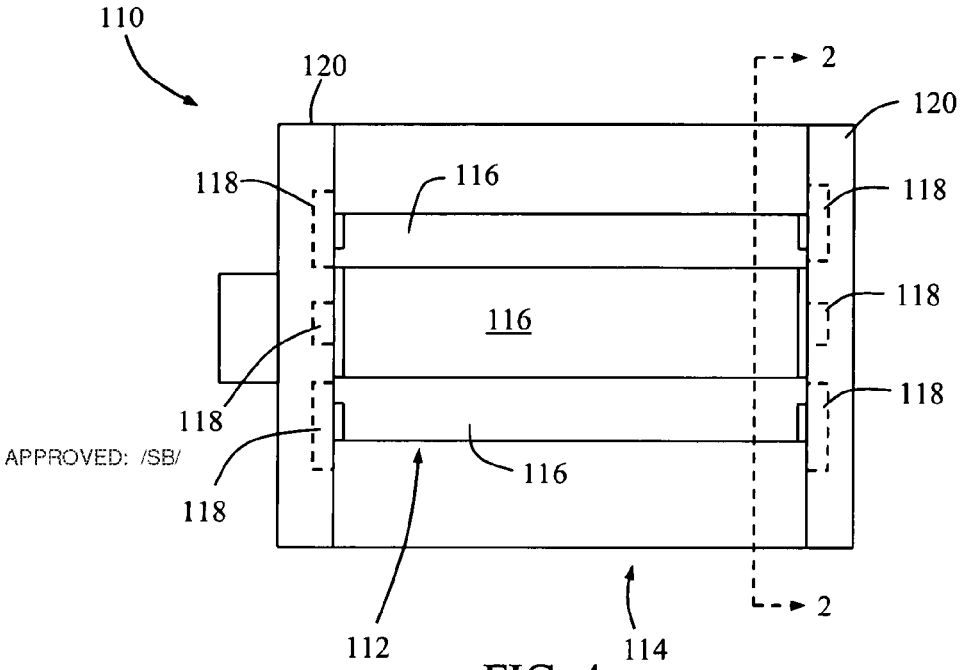
FIG. 4 is a side view of a linear pump according to one embodiment of the present invention.
Figure 5:
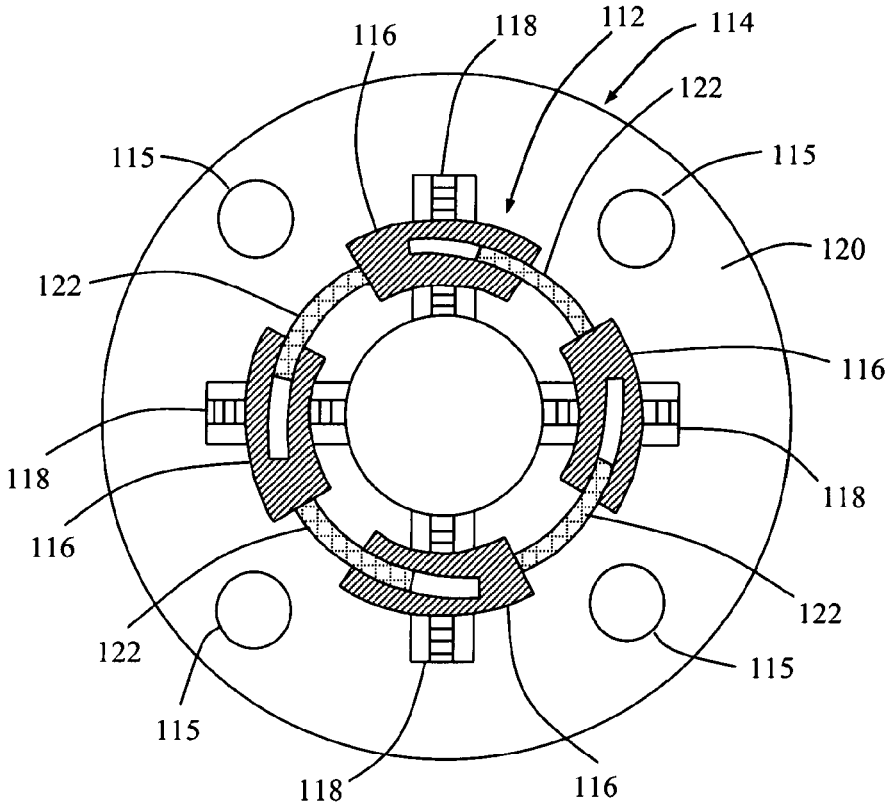
FIG. 5 is a partial sectional view of the linear pump of FIG. 4 taken along lines 2-2 in FIG. 4.
Figure 6:
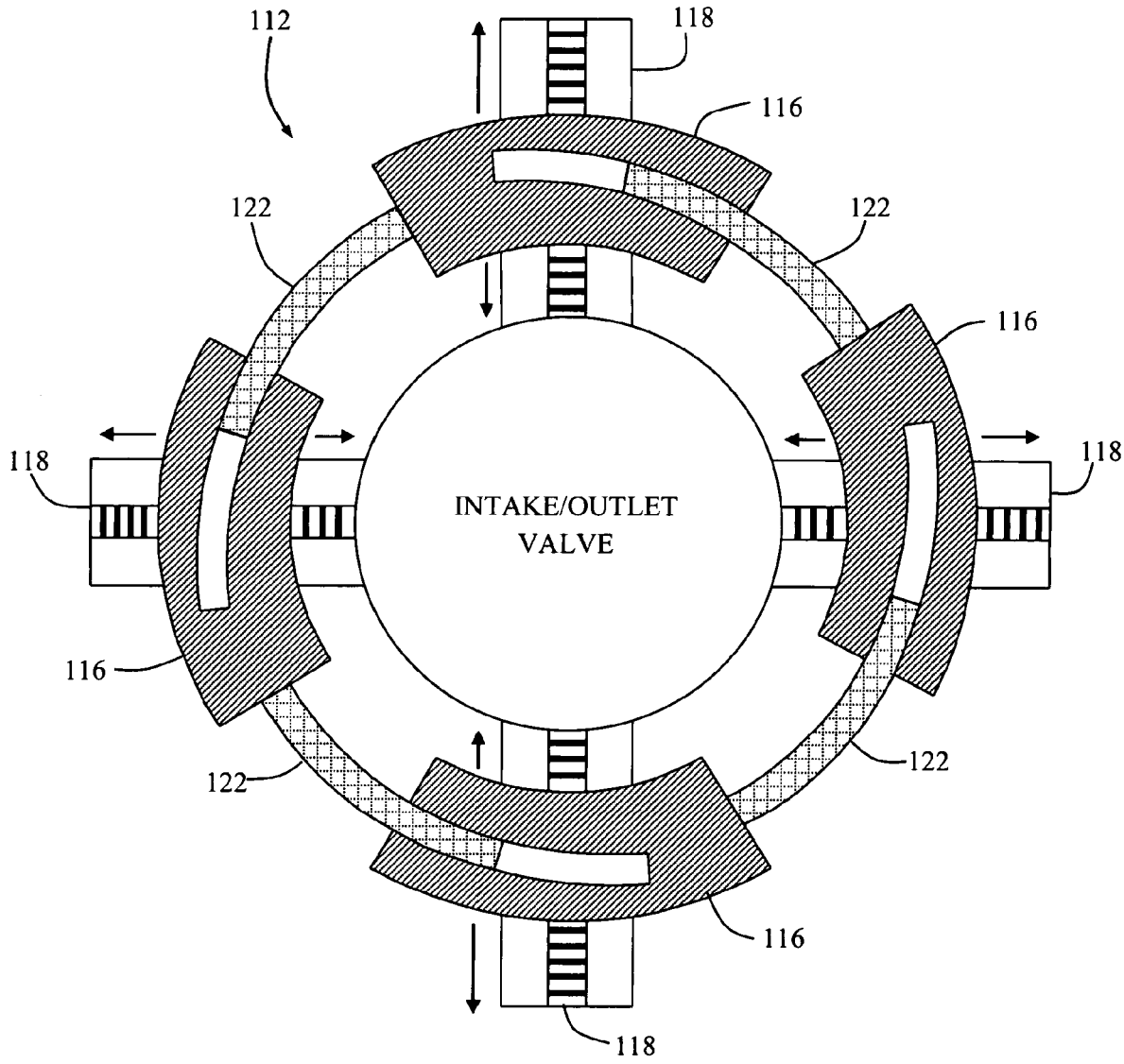
FIG. 6 is an exploded view of the inner chamber of the linear pump of FIG. 4.

FIGS. 1-3 depict a marine transportation vehicle 10 according to one embodiment of the present invention. According to one embodiment of the present invention, this is accomplished by equipping a marine vessel or boat 12 (shown, by way of example only, having two hulls 14). The vessel 12 has one or more sets or "banks" of batteries 16 (such as the 24 volt batteries shown by way of example only) to power the various systems on the vessel. A plurality of solar cells 18 may also be provided to augment and/or supplant the battery banks 16. A computer guidance system 20 may also be provided for guiding and operating the various systems on the vessel 12. Also provided is an antenna 22 for sending and/or receiving data or signals from or to the various systems on the vessel 12. A plurality of sensors 24 may also be employed for providing feedback or input to the various systems on the vessel 12. A motor 26 is coupled to the vessel 12 which, in one embodiment, is capable of being swiveled between a drive position shown and a stability-providing position (not shown, approximately 90 degrees from the drive position). One or more rudders 28 are provided for steering the vessel 12.

In a preferred embodiment, the motor 26 comprises a linear pump that produces power on all strokes and allows full six degrees of freedom (6DOF) vectoring for rapid and efficient directional control. There are very few parts thereby significantly reducing the maintenance, life cycle cost, energy consumption, weight, and volume. By way of example only, the linear pump may be of a type generally shown and described in U.S. Pat. Nos. 6,352,455 and 6,607,368, the entire contents of which are hereby incorporated into this disclosure as if set forth in their entirety herein.

FIGS. 4-8 depict a linear pump 110 according to an embodiment of the present invention, also shown and described in U.S. Provisional App. Ser. No. 60/497,836 filed Aug. 25, 2003 to inventor Anthony Ross, as well as corresponding U.S. Non-Provisional App. Ser. No. 10/926,627 being filed concurrently herewith, the entire contents of which are hereby incorporated by reference into this disclosure as if set forth fully herein. The linear pump 110 of the present invention is similar to the linear pumps of the '455 and '368 patents in that it includes an inner chamber 112 disposed within an outer chamber 114, each having one or more inlets and outlets for passing fluid into and out of each respective chamber to pump fluid. The linear pump 110 of the present invention is different from (and improved relative to) the linear pump of the '455 and '368 patents in that the outer chamber 114 and inner chamber 112 are both generally rigid, wherein the circumference of the inner chamber 112 may be adjusted via a plurality of generally rigid ribs 116 and linear motors 118, and wherein the end plates 120 do NOT move relative to one another.

In one embodiment, the outer chamber 114 of linear pump 110 is generally rigid, and includes a plurality of intake ports 115 to permit fluid to enter into the outer chamber 114 (including but not limited to one-way check valves) and a plurality of outlet ports to permit movement of the fluid or relative fluid of the device (including but not limited to one-way check valves). The inner chamber 112 is constructed from a plurality of generally rigid plate members or "slat-like" ribs 116 which run the length of the pumping system of the present invention. Each rib member 116 cooperates with one or more linear motors 118 such that the rib members 116 may be selectively forced in a radial (i.e. outward) direction and medial (i.e. inward) direction.

Figure 7:
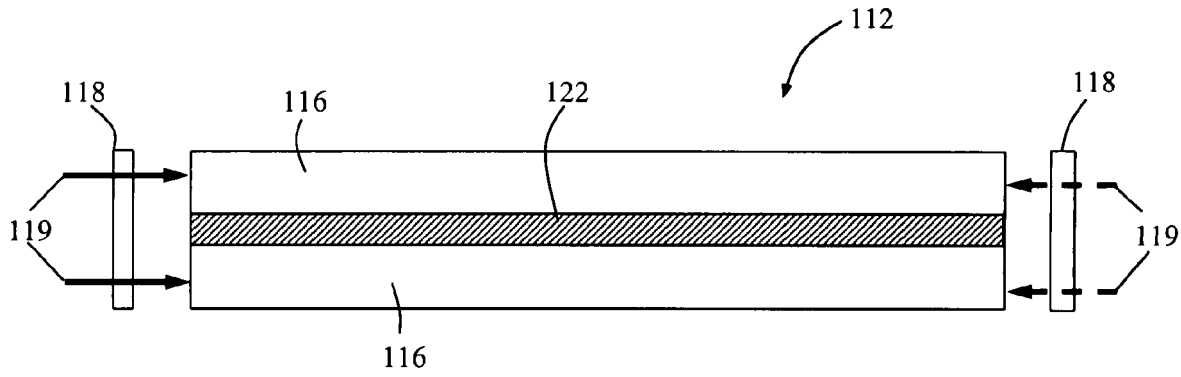
FIG. 7 is an exploded view of a rib member forming part of the inner chamber of the linear pump of FIG. 4.
Figure 8:
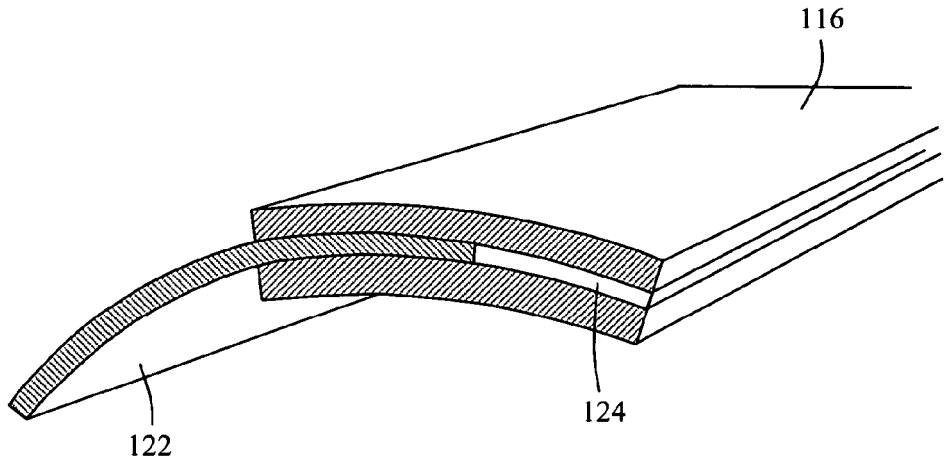
FIG. 8 is a perspective view of a rib member forming part of the inner chamber of the linear pump of FIG. 4.
Figure 9:
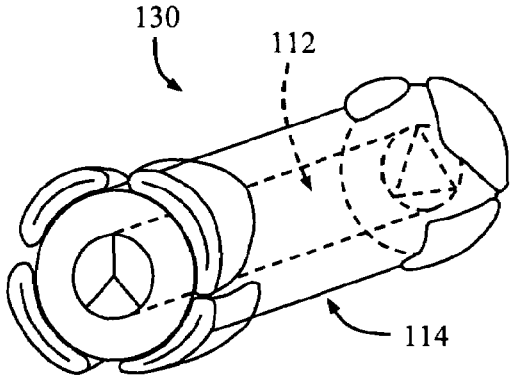
FIG. 9 is a perspective view of a linear pump according to an alternative embodiment of the present invention.

To facilitate this radial and medial motion, each rib member 116 is equipped with an articulating member 122 which engages into a groove 124 formed within an adjacent rib member 116. As an example, both the rib members 116 and the articulating members 122 are generally curved such that the inner chamber 112 is generally cylindrical. As the linear motors 118 are operated, the rib members 116 are caused to expand and contract within the generally rigid outer chamber 114. In a preferred embodiment, the linear motors 118 include permanent magnets, but any of a variety of suitable linear drive mechanisms may be employed without departing from the scope of the present invention, including but not limited to hydraulic and pneumatic systems. To ensure no pressure loss during operation, the articulating member may be equipped with any of a variety of sealing features, including but not limited to O-rings or the like to prevent the passage of fluid in between the adjacent rib members 116 during contraction and/or expansion. As illustrated in FIG. 7, the rib members 116 may be attached to the linear motors (by way of example only) by recessed screws 119 inserted into either end of the rib member 116.

One advantage of this design is that, unlike the linear pump systems shown and described in the '455 or '368 patents, the inner chamber 112 is not a bladder which will stretch and recover. The power is 90-degree opposition, which provides close to a 100% power exchange instead of the 70% with the flexible bladder of the '455 or '368 patents. This is a significant distinction in that it will allow the pump 110 of the present invention, when attached to a vehicle or appropriate size and construction, to actually propel the vehicle from a position on top of or under the water to an airborne state out of the water.

Figure 10:
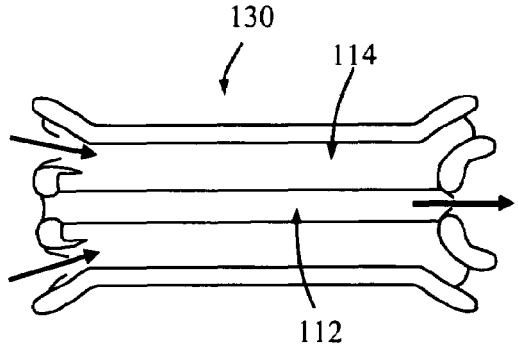
FIG. 10 is a side cross-sectional view of the linear pump of FIG. 9 illustrating the simultaneous inner chamber fluid discharge and outer chamber fluid charge according to the present invention.
Figure 11:
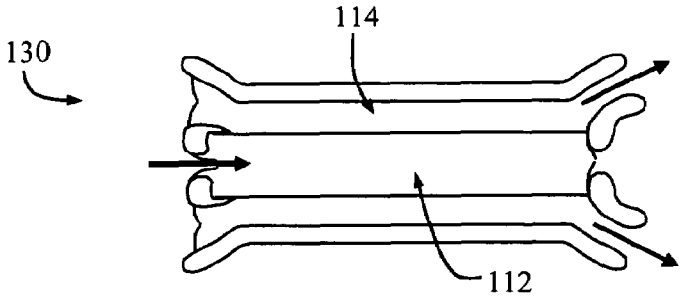
FIG. 11 is a side cross-sectional view of the linear pump of FIG. 9 illustrating the simultaneous outer chamber fluid discharge and inner chamber fluid charge according to the present invention.

FIGS. 9-13 illustrate the use of a linear pump 130 according to an alternative embodiment of the present invention. The main difference between linear pump 130 and linear pump 110 of FIGS. 4-8 is that the outer chamber 114 of linear pump 130 has inlets and outlets disposed along the outer periphery of the outer chamber 114. As shown in FIG. 10, linear pump 130 (along with linear pump 110) is capable of simultaneously discharging the fluid within the inner chamber 112 while fluid is charged or delivered into the outer chamber 114 according to the present invention. The inverse is also true, as shown in FIG. 11, wherein the linear pump 130 (as well as linear pump 110) is capable of simultaneously discharging the fluid within the outer chamber 114 while fluid is charged or delivered into the inner chamber 112 according to the present invention.

Figure 12:
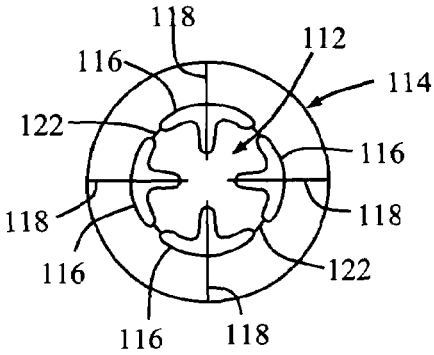
FIG. 12 is a side view of the linear pump of FIG. 9 illustrating the inner chamber in a contracted state.
Figure 13:
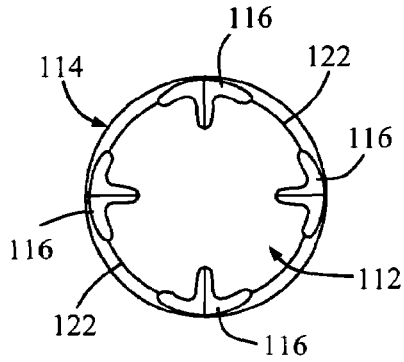
FIG. 13 is a side view of the linear pump of FIG. 9 illustrating the inner chamber in an expanded state.

FIG. 12 is a side view of the linear pump 130 illustrating the inner chamber 112 in a contracted state. FIG. 13 is a side view of the linear pump 130 illustrating the inner chamber 112 in an expanded state.

Although described herein as suitable for unmanned use, it will be appreciated that the marine vessel of the present invention may also be equipped to be manned with one or more users.

The marine vehicle 10 of the present invention, including any or all its constituent parts, may be dimensioned in any size depending upon the application.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternatives falling within the spirit and scope of the invention as defined herein and claimed below.

The invention claimed is:

1. A marine transportation system, comprising:

a vessel capable of progressing through water; and a linear pump including a generally rigid outer chamber having at least one fluid inlet and at least one fluid outlet and an inner chamber disposed within said outer chamber, said inner chamber having at least one fluid inlet and at least one fluid outlet and comprising a plurality of generally rigid walls configured to radially migrate to change the volume within said inner chamber to force fluid from said at least one fluid inlet of said inner chamber to said at least one fluid outlet of said inner chamber, said linear pump coupled to said vessel for propelling said vessel through said water.

2. The marine transportation system of claim 1 and further, wherein said vessel is dimensioned to progress substantially above the surface of said water.

3. The marine transportation system of claim 1 and further, wherein said linear pump is coupled to said vessel via a swivel arrangement capable of positioning said linear pump to provide at least two degrees of directional control.

4. The marine transportation system of claim 1 and further, comprising a power supply system including at least one battery for supplying power to said linear pump.

5. The marine transportation system of claim 1 and further, comprising a power supply system including at least one solar cell for supplying power to said linear pump.

6. The marine transportation system of claim 1 and further, comprising a computer guidance system for guiding and operating said linear pump.

7. The marine transportation system of claim 1 and further, comprising at least one sensor for providing feedback to said linear pump.

8. The marine transportation system of claim 1 and further, wherein said vessel is equipped with at least one seat for carrying a passenger.

9. The marine transportation system of claim 1 and further, comprising at least one antenna for at least one of sending signals from said vessel and receiving signals on said vessel.

10. A method of providing marine transportation, comprising:

equipping a vessel capable of progressing through water with a linear pump including a generally rigid outer chamber having at least one fluid inlet and at least one fluid outlet and an inner chamber disposed within said outer chamber, said inner chamber having at least one fluid inlet and at least one fluid outlet and comprising a plurality of generally rigid walls configured to radially migrate to change the volume within said inner chamber to force fluid from said at least one fluid inlet of said inner chamber to said at least one fluid outlet of said inner chamber, said linear pump operable to propel said vessel through said water.

11. The method of providing marine transportation of claim 10 and further, including the sub-step of dimensioning said vessel to progress substantially above the surface of said water.

12. The method of providing marine transportation of claim 10 and further, including the sub-step of coupling said linear pump to said vessel via a swivel arrangement capable of positioning said linear pump to provide at least two degrees of directional control.

13. The method of providing marine transportation of claim 10 and further, including the step of providing a power supply system including at least one battery for supplying power to said linear pump.

14. The method of providing marine transportation of claim 10 and further, including the step of providing a power supply system including at least one solar cell for supplying power to said linear pump.

15. The method of providing marine transportation of claim 10 and further, including the step of providing a computer guidance system for guiding and operating said linear pump.

16. The method of providing marine transportation of claim 10 and further, including the step of providing at least one sensor for providing feedback to said linear pump.

17. The method of providing marine transportation of claim 10 and further, including the sub-step of equipping said vessel with at least one seat for carrying a passenger.

18. The method of providing marine transportation of claim 10 and further, including the step of providing at least one antenna for at least one of sending signals from said vessel and receiving signals on said vessel.

* * * * *